United States Patent [19]

Hayashi et al.

[11] Patent Number: 4,715,922

[45] Date of Patent: Dec. 29, 1987

[54] AUTOMATIC PAPER ROLL PASTING APPARATUS FOR ROTARY PRESSES

[75] Inventors: Mamoru Hayashi, Kawasaki; Hideo Kawamori, Yokohama, both of Japan

[73] Assignee: Tokyo Kikai Seisakusho, Ltd., Japan

[21] Appl. No.: 846,601

[22] Filed: Mar. 31, 1986

[30] Foreign Application Priority Data

Mar. 30, 1985 [JP] Japan ..... 60-66742

[51] Int. Cl.[4] ..... B65H 19/16; B65H 19/18; B65H 19/20

[52] U.S. Cl. ..... 156/361; 156/504; 242/58.1; 242/58.2; 242/58.3; 242/75.45; 242/75.47

[58] Field of Search ..... 156/502, 504, 361; 242/58.1, 58.3, 58.5, 75.45, 75.52, 58.2, 75.47

[56] References Cited

U.S. PATENT DOCUMENTS 3,516,617 6/1970 Haner et al. ..... 156/504 X

*Primary Examiner*—Donald E. Czaja
*Assistant Examiner*—Jeff H. Aftergut
*Attorney, Agent, or Firm*—McGlew and Tuttle

[57] ABSTRACT

An automatic paper roll pasting apparatus, for sequentially and continually feeding a continuous strip of paper, or a paper web, to a rotary press from a plurality of paper rolls, having a paper roll support capable of accommodating at least two paper rolls, a mechanism for measuring a value relating to the diameter of a paper roll newly mounted on the paper roll support, and a mechanism for controlling the revolution of the new paper roll, and constructed so that the revolution of the new paper roll is caused to agree with a desired revolution calculated from the revolution of a paper web which is currently fed to the rotary press, thus enabling the new paper roll to be pasted to the running paper web automatically.

4 Claims, 12 Drawing Figures

FIG. 9
| COUNT (CN1) | 0~cn1 | cn1~cn2 | cn2~cn3 | cn3~cn4 | cn4~cn5 | cn5~cn6 |
|---|---|---|---|---|---|---|
| RATIO OF FREQ. DIV. | m1/n1 | m2/n1 | m3/n1 | m4/n1 | m5/n1 | m6/n1 |
FIG. 11
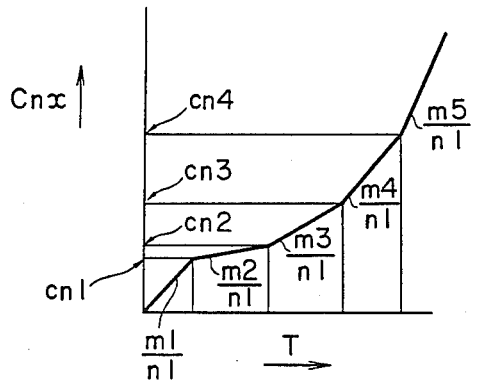
FIG. 12
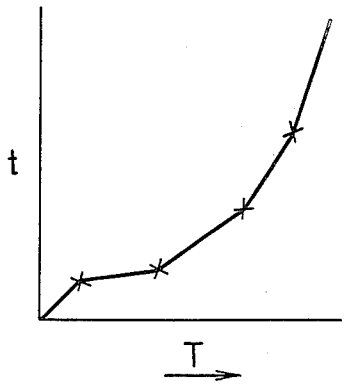

AUTOMATIC PAPER ROLL PASTING APPARATUS FOR ROTARY PRESSES

BACKGROUND OF THE INVENTION

1. Field of the Invention

This invention relates generally to an automatic paper roll pasting apparatus, and more particularly to an automatic paper roll pasting apparatus for rotary presses, which is web-fed and accept a continuous strip of paper from paper rolls to print thereon, constructed so that a paper roll which is now feeding a continuous strip of paper, or a paper web, to the rotary press and approaching to the end thereof with the progress of printing is automatically pasted to a new paper roll without interrupting the operation of the rotary press.

2. Description of the Prior Art

The rotary press is usually used to continuously print newwpaper and other printing material on a continuous strip of paper, or paper web, supplied from a paper roll. To ensure continuous printing in this type of printing machine, a running paper web currently being fed from a paper roll must be automatically pasted to a new paper roll when the residual length of the existing paper roll runs short as printing proceeds. To effect the automatic pasting of paper rolls, the peripheral speed (revolution) of a new paper roll being pasted is caused to agree with the revolution of the running paper web, and then the ends of both paper webs are pasted, for example, by contact-bonding adhesive layers applied in advance on both ends. In order to measure the speed of a paper web now being fed (running paper web) to the rotary press and the peripheral speed of a new paper roll to be pasted so as to cause the revolutions of both to agree with each other, a roller has heretofore been employed, which is brought into contact with the outermost periphery of the rotating paper roll being pasted to measure the peripheral speed of the new paper roll. In such an arrangement, however, the roller for measuring the revolution of the new paper roll being pasted tends to vibrate due to irregularities which would have been produced on the outermost periphery of the paper roll for some reasons, making it difficult to accurately measure the peripheral speed of the new paper roll. SUMMARY OF THE INVENTION This invention is intended to overcome the above problem.

It is the first object of this invention to provide an automatic paper roll pasting apparatus having a means for accurately and quickly measuring the peripheral speed of a rotating new paper roll being pasted without being affected by irregularities produced on the outer periphery of the paper roll.

It is the second object of this invention to provide an automatic paper roll pasting apparatus having a paper roll revolution control means for calculating a revolution signal by correlating the speed of a paper web now being fed with a value relating to the diameter of a new paper roll being pasted, and controlling the revolution of the new paper roll by comparing the calculated revolution signal with the revolution signal of the new paper roll being pasted.

BRIEF DESCRIPTION OF THE DRAWINGS

FIGS. 9 through 12 are diagrams of assistance in explaining the operation of the electrical circuit shown in the block diagram of FIG. 8.

DETAILED DESCRIPTION OF THE EMBODIMENTS

Figure 1:
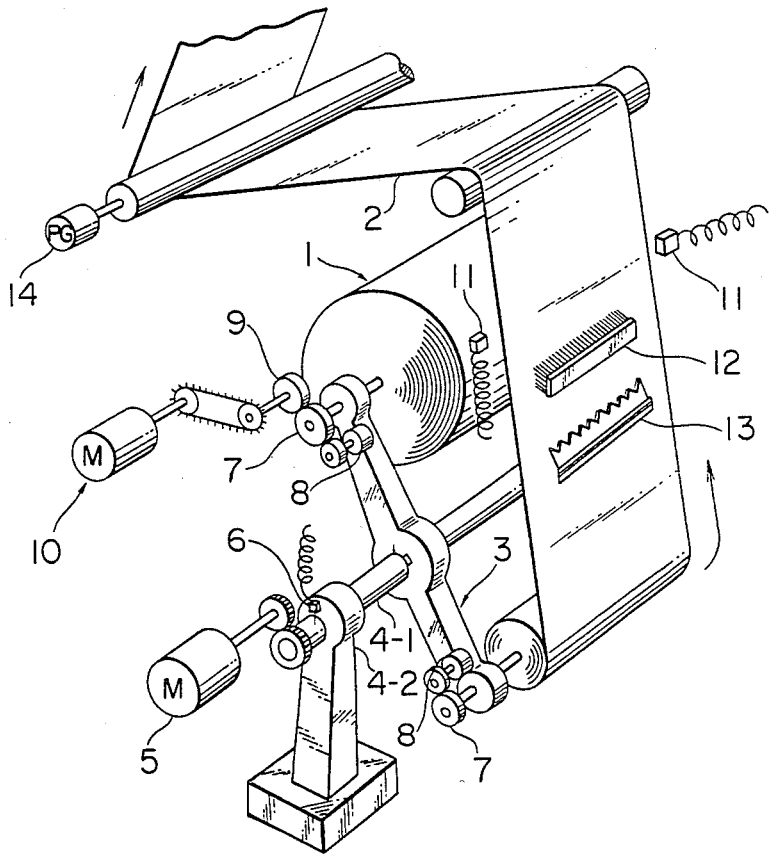
FIG. 1 is a perspective view of an embodiment of this invention.

In the following, embodiments of this invention will be described in detail, referring to the accompanying drawings.

First, the general arrangement of this invention will be described, referring to FIG. 1.

In the figure, reference numeral 1 refers to a new paper roll, on the outer periphery of which glue or other pasting means is applied in advance for pasting to a running paper web 2.

Numeral 2 refers to a running paper web, which is being paid off from a paper roll and printed at high speed.

Numeral 3 refers to a bifurcated arm for supporting the centers of paper rolls at both ends thereof.

Numerals 4-1 and 4-2 refer to a swiveling shaft and a supporting stand, respectively, for causing the bifurcated arm 3 to swivel.

Numeral 5 refers to an electric motor for causing the swiveling shaft 4-1 to rotate.

Numeral 6 refers to a proximity switch, which generates pulses as the swiveling shaft 4-1 passes a given position (angle).

Numeral 7 refers to pulleys mounted on both ends of the bifurcated arm 3; the shaft of each pulley 7 being fixedly fitted to the center of each paper roll by a mechanical means. Both the paper rolls and the pulleys 7 rotate together.

Numeral 8 refers to pulse generators each connected to the pulley 7 via gears, etc. to generate $P_2$ pieces of pulses everytime the pulley 7 (or the new paper roll 1) turns one full turn.

Numeral 9 refers to a pulley adapted to be engaged with and disengaged from the pulley 7, serving as a drive unit to drive the new paper roll 1, when engaged with the pulley 7.

Numeral 10 refers to an electric motor for causing the pulley 9 to rotate via a belt-drive mechanism, which is a variable speed motor (predrive motor) where revolution can be set at any settings.

Numeral 11 is a photoelectric device for setting a predetermined gap between the new paper roll 1 and the running paper web 2, which generates signals everytime a light beam emitted by the light transmitter thereof is intercepted by the new paper roll 1.

Numeral 12 refers to a brush for pressing the running paper web 2 onto the paper roll 1 to effect the pasting of the two.

Numeral 13 refers to a cutter for cutting the running paper web 2 after the running paper web 2 is pasted to the new paper roll 1 by means of the brush 12.

Numeral 14 refers to a pulse generator driven by the running paper web 2 for generating pulses proportional to the revolution of the running paper web 2, for example, $P_1$ pieces of such pulses when the running paper web 2 moves along a distance of 1 meter.

In the following, an example of automatic pasting operations using the device mentioned above will be described.

(1) The new paper roll 1 is attached to the bifurcated arm 3.

(2) Glue or other pasting means is applied to the paper end on the outermost periphery of the new paper roll 1.

(3) The motor 5 is driven to cause the bifurcated arm 3 to rotate, and the gap between the outer periphery of the new paper roll 1 and the running paper web 2 is set to a given distance (normally 15 mm), using the photoelectric device 11.

(4) The pulley 9 and the pulley 7 are brought into contact with each other at the outer periphery thereof.

(5) The number of pulses generated in unit time by the pulse generator 14 is checked to detect the speed of the running paper web 2.

(6) The motor 10 is accelerated while checking the number of pulses generated in unit time by the pulse generator 8 (proportional to the revolution of the new paper roll 1) so that the difference between the actual revolution of the new paper roll 1 and a desired revolution of the new paper roll 1 calculated from the speed of the running paper web becomes within a certain range.

(7) After the difference in revolution has become within a certain range, the running paper web 2 is forced onto the new paper roll 1 at an appropriate timing, using the brush 12.

(8) After the running paper web 2 has been forced onto the new paper roll 1 using the brush 12, the running paper web 2 is cut by the cutter 13 at an appropriate timing to start feeding the new paper roll 1.

The automatic pasting of paper rolls is completed with the procedures described above. The device for carrying out the procedure (6) in the above procedures is called the predrive device. In the following, description will be made as to how control is effected by the predrive device, referring to FIG. 2.

In the figure, pulses generated by the pulse generator ($PG_1$) 14 are counted for a given period of time (t sec.), and the number of pulses counted is converted to an analog value $E_S$ (V) by a D/A converter 15 and fed to a motor control circuit 16. Based on the signals transmitted by the motor control circuit 16, the motor 10 is driven to cause the new paper roll 1 and the pulse generator 8 ($PG_2$).

The number of pulses generated by the pulse generator 8 is converted to an analog value $E_M$ (V) by an F/V (frequency/voltage) converter 17 and fed to the motor control circuit 16.

The voltage of the analog value $E_M$ (V) works to offset the analog value $E_S$ (V), and when the difference between $E_S$ and $E_M$ becomes within a certain range, the motor 10 stops acceleration, leading to a constant-speed operation. Thus, the peripheral speed of the new paper roll 1 is synchronized with the speed of the running paper web 2. In the following, this will be described in more detail.

Figure 2:
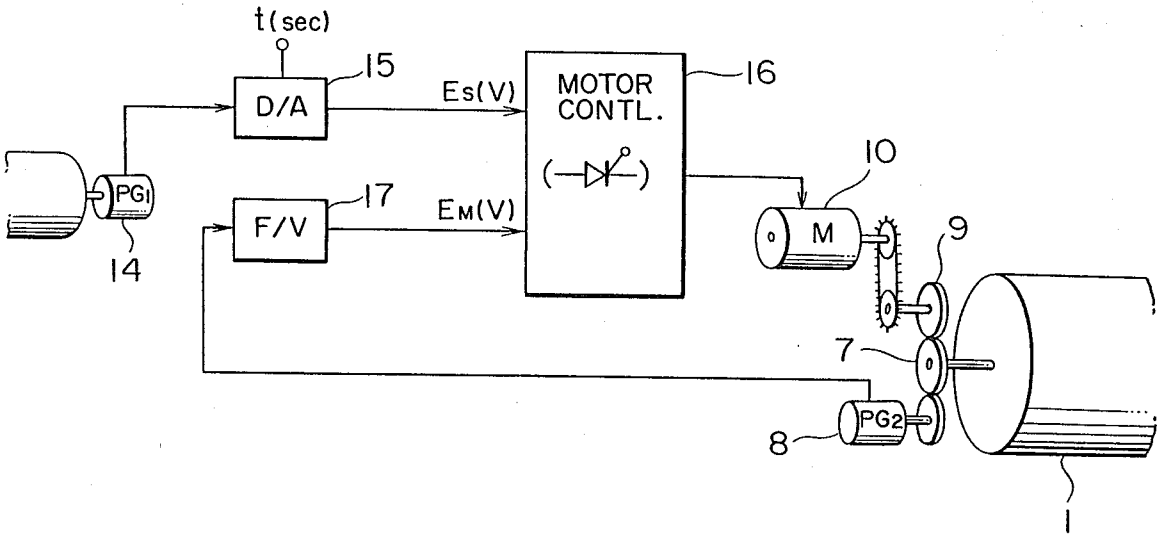
FIG. 2 is a diagram illustrating the essential part of the embodiment shown in the perspective view of FIG. 1.

In FIG. 2, assume that the speed of the running paper web 2 is V (m/sec), the number of pulses counted by the pulse generator 14 when the running paper web 2 moves one meter is $P_1$, 1,000 pulses are converted to a voltage $E_1$ (V) by the D/A converter 15, the number of pulses counted by the pulse generator 8 when the new paper roll 1 turns one turn is $P_2$, the diameter of the new paper roll 1 is D (m), and a frequency of 1,000 (Hz) is converted to a voltage $E_2$ (V) by the F/V converter 17.

Now, the voltage $E_S$ (V) converted and output by the D/A converter 15 corresponding to the speed of the running paper web 2 can be expressed by the following equation if pulses are counted for t seconds and D/A-converted.

$$E_S = V \times P_1 \times t \times \frac{E_1}{1{,}000}\ (V) \tag{1}$$

$$= V \times t \times k_1\ (k_1 \text{ is a constant}) \tag{2}$$

Consequently, the voltage $E_S$ becomes a value proportional to the speed V of the running paper web 2 when the counting time t is constant. Conversely, when the speed V of the running paper web 2 is constant, a two-fold increase in the time t doubles the voltage $E_S$.

The time t is set in accordance with the diameter D of the new paper roll 1, as will be described later. By doing so, the voltage $E_S$ becomes a value corresponding to a desired revolution of the new paper roll 1 calculated from the speed V of the running paper web 2 by taking into account the diameter D.

The voltage $E_M$ (V) converted and output by the F/V converter 17 in accordance with the revolution of the new paper roll 1 can be expressed by the following equation.

$$E_M = (\text{revolution of paper roll}) \times P_2 \times \frac{E_2}{1{,}000} \tag{3}$$

$$= \frac{V}{\pi D} \times P_2 \times \frac{E_2}{1{,}000}$$

$$= \frac{V}{D} \times k_2\ (k_2 \text{ is a constant})$$

Consequently, when the diameter D of the new paper roll is constant, the voltage $E_M$ is proportional to the speed V of the running paper web 2, whereas when the speed V of the running paper web 2 is constant, $E_M$ is inverse to the diameter D of the new paper roll 1. A two-fold increase in the diameter D reduces the voltage $E_M$ by a factor of $\frac{1}{2}$.

Figure 3:
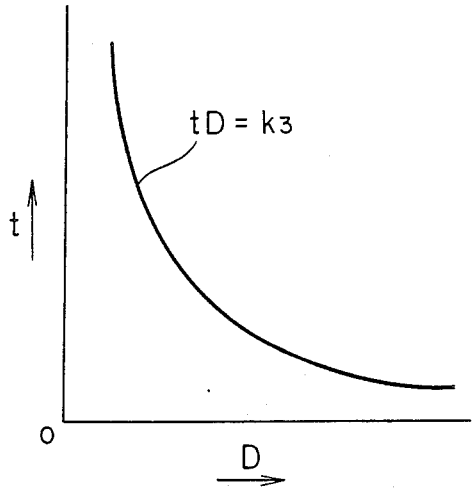
FIGS. 3 through 7 are diagrams of assistance in explaining the operation of the essential part shown in FIG. 2.

The speed of the motor 10 is controlled so that the difference between the voltage $E_S$ and the voltage $E_M$, as given by Equations (2) and (3) above, is kept at zero at all times. That is, $$E_S - E_M = V \cdot t \cdot k_1 - \frac{V}{D} \cdot k_2 = 0 \tag{4}$$

$$V\left(t \cdot k_1 - \frac{1}{D} k_2\right) = 0$$

$$tk_1 = \frac{1}{D} k_2\ (\because V \neq 0)$$

$$t \cdot D = k_3\left(k_3 = \frac{k_2}{k_1}\right)$$

where $k_3$ is a constant. This means that $t \times D$ must be constant. Equation (4) can be diagramatically expressed by FIG. 3. If the diameter D of the paper roll 1 increases by two-times, three-times or 1/n times, $t \times d$ can be kept constant by increasing the pulse counting time on the running paper web by ½ times, ⅓ times or n times, respectively. That is, merely by knowing the diameter D of the new paper roll 1, the revolution of the new paper roll 1 can be synchronized with a desired revolution of the paper roll 1 calculated from the speed of the running paper web 2 by setting t, counting the number of pulses on the side of the running paper web 2 for a period of t, converting the number of pulses to an analog value, and accelerating the revolution of the new paper roll 1.

Figure 4:
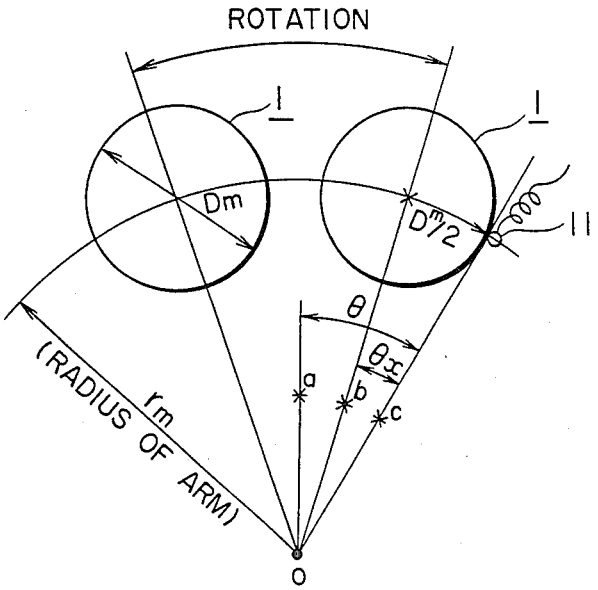

Next, description will be made as to how to measure the diameter D of the new paper roll 1. In FIG. 4, assume that the diameter of the new paper roll 1 is D (m), the length of the arm 3 is $r_m$ (m), the time required to turn the arm 3 one turn is $T_a$ (sec), the position at which the proximity switch 6 detects the center of the turning arm 3 and generates a pulse is point a, the position at which the photoelectric device 11 generates a pulse as a light beam of the light transmitter thereof is intercepted by the outer periphery of the new paper roll 1 as the arm 3 turns is point b, and the position at which the photoelectric device is installed is point c.

Figure 5:
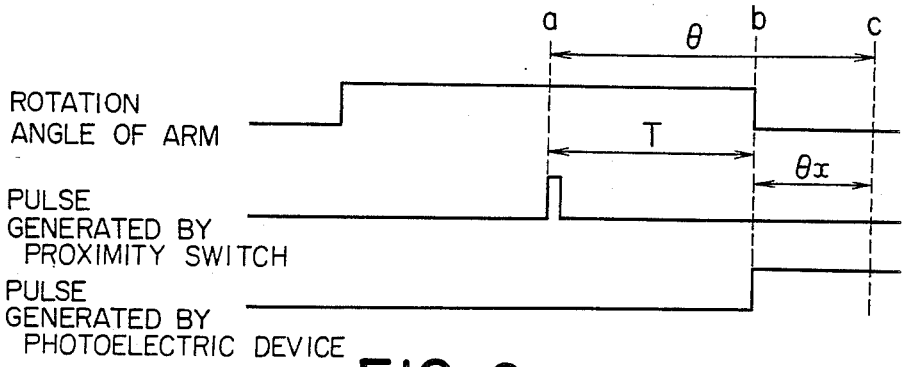
Figure 6:
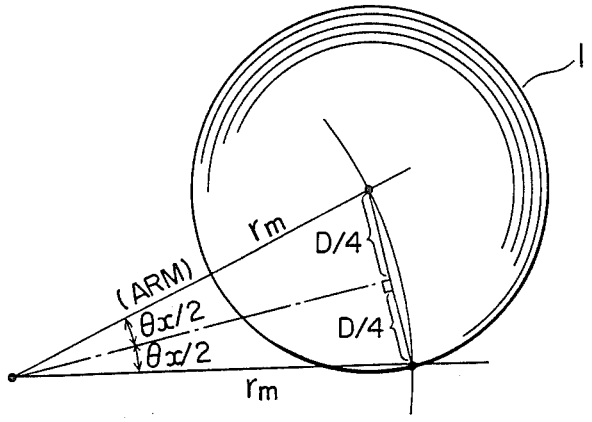

Now, assume that the time required for the arm 3 moves from the point a to the point b, as shown in FIG. 5, is T, $$T = \frac{\theta - \theta x}{360} \times T_a \tag{5}$$

$$= \frac{T_a}{360}\left(\theta - 2\sin^{-1}\frac{D}{4r_m}\right)$$

where θx can be obtained by the following equation, as is evident from FIG. 6.

$$\theta x = 2\sin^{-1}\frac{D}{4r_m}$$

Since $T_a$ (the time required for the arm 3 to turn one turn), θand $r_m$ in Equation (5) are all constants, the diameter D of the new paper roll 1 can be known by measuring the time t.

Figure 7:
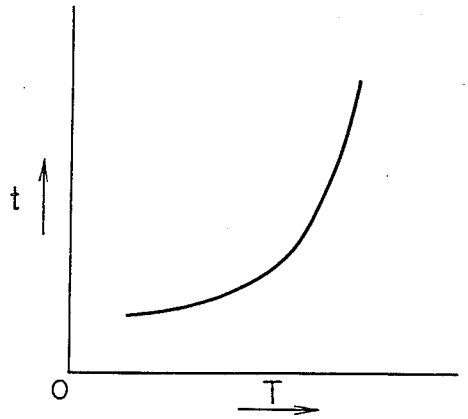

Plotting the values of t calculated with respect to T from Equations (2) and (3) yields FIG. 7. This will be described in more detail in the following.

The following equation can be obtained from Equations (2), (3) and (4).

$$K_1 = \frac{P_1}{1{,}000} \cdot E_1 \tag{6}$$

$$k_2 = \frac{P_2}{1{,}000} \cdot E_2 \cdot \frac{1}{\pi} \tag{7}$$

$$t \cdot D = k_3 = \frac{k_2}{k_1} \tag{8}$$

Substituting Equations (6) and (7) into Equation (8) and rarranging the resulting equation leads to the following equation.

$$t = \frac{1}{D} \times \frac{P_2}{P_1} \times \frac{E_2}{E_1} \times \frac{1}{\pi} \tag{9}$$

$$= \frac{k_3}{D}$$

-continued $$\text{where } k_3 = \frac{E_2 P_2}{\pi E_1 P_1}$$

D can be obtained from the following equation as a transformation of Equation (5).

$$D = 4r_m(\text{Sin}(\theta/2 - T(180/T_a))) \tag{5'}$$

Equation (5)′ shows the diameter D of a paper roll 1 can be calculated merely by determining the time required for the arm to revolve and move, without measuring directly the diameter D. Furthermore, substituting Equation (5)′ into Equation (9) yields the following equation.

$$t = \frac{k_4}{\text{Sin}(k_5 - k_6, T)} \tag{10}$$

$$\text{where } k_4 = \frac{K_3}{4},\ k_5 = \frac{\theta}{2},\ k_6 = \frac{180}{T_a}$$

As is apparent from Equation (10), the time t for measuring pulses on the web side can also be calculated merely be measuring the time T required for the arm to revolve and move, without measuring directly the diameter D of the paper roll 1.

As described above, the speed of the running web 2 can be caused to agree with the peripheral speed of the paper roll 1 by measuring an easily and positivley measurable value related to the diameter of the paper roll 1, that is, the time T required for the arm to revolve and move, instead of measuring the diameter D.

Next, description will be made, using the block diagram shown in FIG. 8, as to the circuit for providing from T the values of t as shown by a curve in FIG. 7 and how to obtain the voltage $E_S$ based on the values of t.

In FIG. 1, as the bifurcated arm 3 turns and the center thereof passes in the vicinity of the proximity switch 6, a pulse is generated. The pulse is fed to the terminal S of a flip-flop FF1, turning the output Q of the flip-flop FF1 to "H". As the output Q becomes "H", an input of an AND gate G1 is also turned to "H". Thus, a clock $\phi_{1x}$ connected to another input of the AND gate G1 is output from the AND gate G1. The clock $\phi_{1x}$ is fed into a counter CN1 and counted. The output of the counter CN1 is fed to a comparator 21 and a ratio changer 22. The output of the ratio changer 22 is connected to a frequency divider 23, enabling the frequency dividing ratio of the frequency divider 23 to be controlled by the ratio changer 22. A clock $\phi_1$ (fixed) is input to the frequency divider 23. The frequency divider 23 divides the clock $\phi_1$ in accordance with a setting on the ratio changer 22 into the clock $\phi_{1x}$, and feeds the clock $\phi_{1x}$ to the AND gate G1. The ratio changer 22 is capable of controlling the frequency dividing ratio in the frequency divider 23 based on the count given by the counter CN1, as shown in FIG. 9.

The counter CN1 counts the clock $\phi_1$ while dividing into the clock $\phi_{1x}$. As the light beam in the photoelectric device is intercepted by the new paper roll 1, an "H" signal is generated and fed to the terminal R of the flip-flop FF1. The output Q is turned to "L", causing the input of the AND gate G1 to turn to "L". With this, the inputting of the clock $\phi_{1x}$ to the counter CN1 is interrupted, and the clock count at that time is held in the counter CN1. The clock count is also input into the comparator 21.

When the motor ("predrive" motor) 10 is turned on to start driving, the input of an AND gate G2 is turned to "H", causing the output thereof to turn to "H" as Step 1. Since the output is connected to the terminal S of a flip-flop FF2, the flip-flop FF2 is set, causing the output Q of the flip-flop FF2 to turn to "H". As the output Q also causes the ENABLE terminal of a counter CN2 to turn to "H", the counter CN2 starts counting a clock $\phi_2$ (fixed). The output of the counter CN2 is input to the comparator 21 to compare with the contents of the counter CN1. When the output Q of the flip-flop FF2 is turned to "H", the ENABLE terminal of a counter CN3 is also turned to "H". At the same time, the counter CN3 also starts counting the number of pulses from the pulse generator 14. The output of the counter CN3 is connected to the input of a shift register 24.

As Step 2, the counter CN2 performs counting, and when the count by the counter CN2 becomes equal to the count by the counter CN1, the output of the comparator 21 becomes "H". This "H" signal is input to the shift register 24, causing all the data on the input side of the shift register 24 at that time to be output to the output side. Since the output "H" of the comparator 21, at the same time, passes in an inverter to turn the input of the AND gate G2 to "L", the output of the AND gate G2 is also turned to "L", resetting the flip-flop FF2. Then, the output Q of the flip-flop FF2 is turned to "L" causing the ENABLE terminals of the counters CN2 and CN3 to "L". To turn the reset terminals of the counters CN2 and CN3 to "H", the counts of the counters CN2 and CN3 become "0". Turning the output of the counter CN2 to "0" causes a difference with the counts of the counter CN1, turning the output of the comparator 21 to "L".

The output "L" of the comparator 21 passes through the inverter and turns to "H", causing the input of the AND gate G2 to turn to "H", and therefore the output thereof is also caused to turn to "H". As the output of the AND gate G2 is turned to "H", the flip-flop FF2 is set again, turning the output Q thereof to "H", causing the counters CN2 and CN3 to start counting.

Thereafter, Steps 1 and 2 are sequentially repeated in the same manner as described above. Thus, the voltage $E_S$ proportional to the count by the shift register 24 is output by the D/A converter 25 because the output of the shift register 24 is input to the D/A converter 25.

Figure 10:
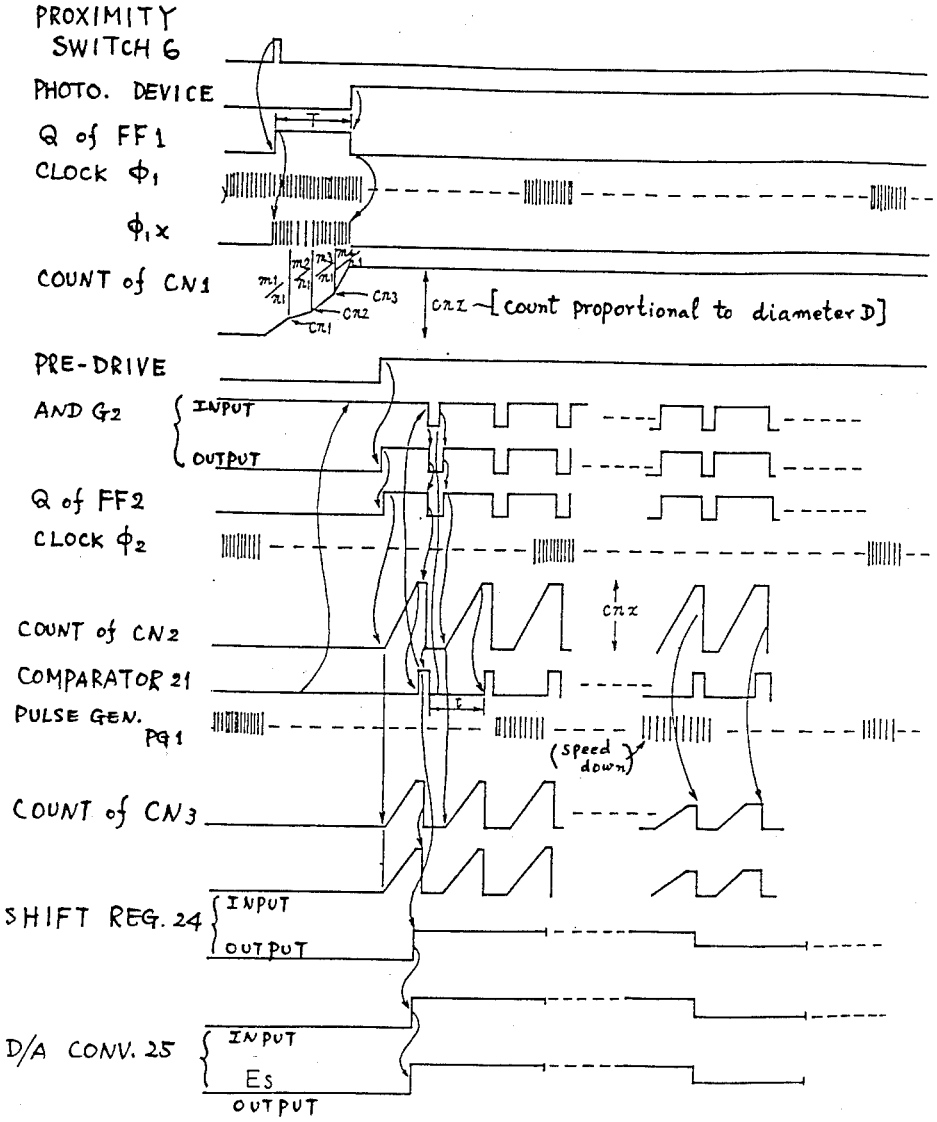

The aforementioned operations plotted with respect to time are shown in FIG. 10.

Figure 8:
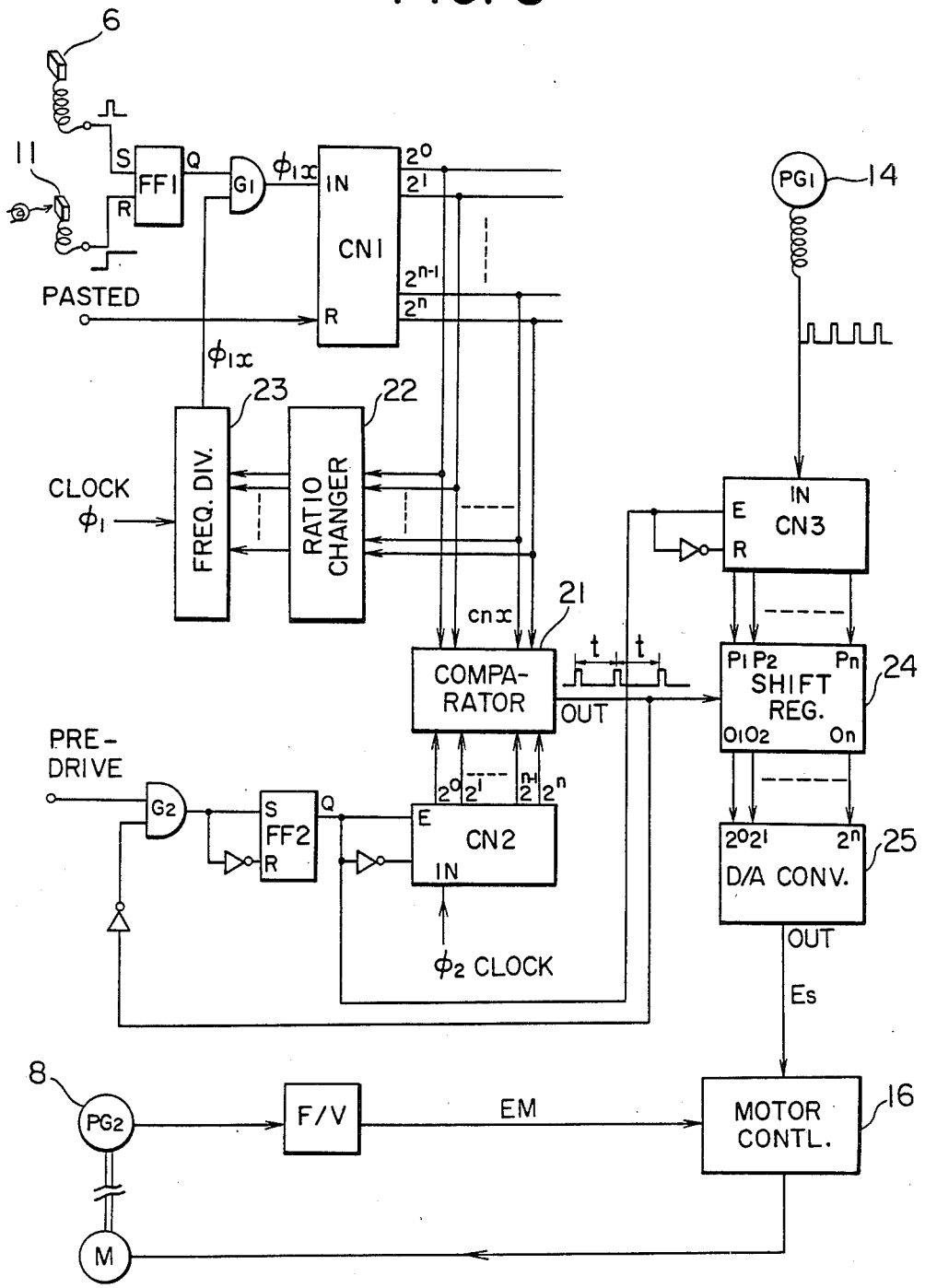
FIG. 8 is a block diagram illustrating an electrical circuit used in the essential part shown in FIG. 2.

In FIGS. 7 and 8, the time elapsed from the setting to the resetting of the flip-flop FF1 can be expressed by T, which has been described above. The values counted by the counter CN1 within a period of T is $C_{nx}$. Changes in $C_{nx}$ with respect to T are shown in FIG. 11. This is because the frequency of the clock $\phi_{1x}$ to be input to the counter CN1 is changed by the count on the counter CN1. When the count $C_{nx}$ counted by the counter CN1 becomes equal to the count of the clock $\phi_2$ counted by the counter CN2, pulses are repeatedly generated by the comparator 21. And, the time equivalent to the gap between these pulses is t shown in FIG. 7.

$$t = C_{nx} \times 1/\phi_2$$

This means that t is obtained by dividing the count $C_{nx}$ shown in FIG. 11 with the clock $\phi_2$, as shown in FIG. 12. On the counter CN3, counted are pulses corresponding to the speed of the running paper web 2 in t seconds. The counted pulses are output by the D/A converter 25 in the form of the voltage $E_S$, which serves as a speed instruction for the motor (predrive motor) 10. In other words, the time t is inverse to the diameter D of the new paper roll 1, during which the pulses of the running paper web 2 (which are proportional to the speed of the running paper web 2) are counted, converted to analog values to control the speed of the predrive motor 10. Thus, control is effected to synchronize the peripheral speed of the new paper roll 1 with the speed of the running paper web 2.

As described above, this invention employs a construction in which when the residual amount of running paper web on a paper roll now being fed to a rotary press runs short, control is effected to cause the peripheral speed of a new paper roll being spliced to agree with a desired speed for the new paper roll calculated from the speed of the running paper web by causing the signal for the speed of the new paper roll being replaced to agree with the signal determined from a speed value obtained by correlating a value relating to the diameter of the new paper roll with the speed of the running paper web.

In a rotary press of the latest type, the speed of a running paper web is sufficiently high, with the variations thereof being small. Consequently, the revolution signal obtained from the pulse generator shown in FIG. 2 is of a sufficiently high level, even for a new paper roll of a significantly large diameter, with variation in level being very small. In this invention, therefore, both the signals $E_S$ and $E_M$ shown in FIG. 2 may be of a sufficiently high level, and control can be effected with high accuracy because signals of such a high level are compared with each other. In this invention, furthermore, circuits used for obtaining signals $E_S$ and $E_M$ may be of a simple configuration. This may lead to an even higher control accuracy.

What is claimed is:

1. An automatic paper roll pasting apparatus for rotary presses for sequentially and continually feeding a continuous strip of paper, or a paper web, to a rotary press from a plurality of paper rolls, and characterized in that a paper roll support capable of accommodating at least two or more paper rolls, a paper roll measuring means for measuring a value relating to the diameter of a new paper roll mounted on said paper roll support, and a paper roll revolution control means for calculating a signal in the form of a revolution signal by correlating said value relating to the diameter of said new paper roll measured by said paper roll measuring means with the speed of a running paper web being fed to said rotary press from another paper roll mounted on said paper roll support to control the revolution of said new paper roll by comparing said calculated revolution signal with said revolution signal of said new paper roll are provided; and that said paper roll revolution control means is adapted to coincide the revolution of said new paper roll with desired revolution of said new paper roll calculated from the speed of said running paper web, and said new paper roll is pasted, by pasting with adhesive, for example, with said paper web.

2. An automatic paper roll pasting apparatus for rotary presses set forth in claim (1) wherein said revolution signal of said new paper roll is produced by measuring the revolution of said new paper roll which is caused to be rotated prior to the pasting of said new paper roll to said running paper web.

3. An automatic paper roll pasting apparatus for rotary presses set forth in claim 1, wherein said signal calculated in the form of a revolution signal is given by a value obtained by multiplying the speed value V of said running paper web being fed to said rotary press by a value which is a function of the diameter D of said new paper roll.

4. An automatic paper roll pasting apparatus for rotary presses for sequentially and continually feeding a continuous strip of paper, or a paper web, to a rotary press from a plurality of paper rolls, having a paper roll support capable of accommodating at least two or more paper rolls, a paper roll diameter measuring means for measurinq a value relating to the diameter of a new paper roll mounted on said paper roll support, and a paper roll revolution control means for calculating a signal in the form of a revolution signal by correlating said value relating to the diameter of said new paper roll measured by said paper roll diameter measuring means with the speed of a running paper web being fed to said rotary press from another paper roll mounted on said paper roll support to control the revolution of said new paper roll by comparing said calculated revolution signal with said revolution signal of said new paper roll; and characterized in that said paper roll revolution control means is adapted to coincide the revolution of said new paper roll with the desired revolution of said new paper roll calculated from the speed of said running paper web, and said new paper roll is pasted, by pasting with adhesive, for example, with said paper web, said paper roll diameter measuring means having such a construction that the diameter of said new paper roll is calculated from a pulse output generated by a photoelectric device disposed at a predetermined angular position so that said new paper roll mounted on said paper roll support intercepts a light beam produced from said photoelectric device as said new paper roll is moved by the rotation of an arm provided on said paper roll support, a pulse output generated by an arm reference point detecting device disposed at an angular position as the reference point for the rotation of said paper roll support arm, and the length of said paper roll support arm.

* * * * *